US007048813B2

(12) United States Patent
Miyazaki

(10) Patent No.: US 7,048,813 B2
(45) Date of Patent: May 23, 2006

(54) FOIL-FORM SOLDERING METAL AND METHOD FOR PROCESSING THE SAME

(75) Inventor: Ken-ichi Miyazaki, Hiratsuka (JP)

(73) Assignee: Tanaka Kikinzoku Kogyo K.K., Tokyo (JP)

( * ) Notice: Subject to any disclaimer, the term of this patent is extended or adjusted under 35 U.S.C. 154(b) by 366 days.

(21) Appl. No.: 10/318,386

(22) Filed: Dec. 13, 2002

(65) Prior Publication Data

US 2003/0164214 A1 Sep. 4, 2003

(30) Foreign Application Priority Data

Dec. 13, 2001 (JP) ..... P2001-380493

(51) Int. Cl.
*C22C 30/00* (2006.01)
*C22C 1/14* (2006.01)

(52) U.S. Cl. ..... 148/442; 148/430; 148/559; 148/678; 148/707; 420/507; 420/557; 420/589; 228/563

(58) Field of Classification Search ..... 228/56.3; 148/442, 430, 559, 678, 707; 420/507, 557, 420/589

See application file for complete search history.

(56) References Cited

U.S. PATENT DOCUMENTS 5,095,359 A * 3/1992 Tanaka et al. ..... 257/703
6,700,913 B1 * 3/2004 Pinneo et al. ..... 372/43

FOREIGN PATENT DOCUMENTS

JP 6-234001 8/1994

OTHER PUBLICATIONS

The American Heritage Dictionary of the American Language, 1976, pp. 756-757.*

* cited by examiner

*Primary Examiner*—John P. Sheehan
(74) *Attorney, Agent, or Firm*—Rothwell, Figg, Ernst & Manbeck, P.C.

(57) ABSTRACT

The present invention provides a processing method capable of continuously working an Au—Sn soldering metal having a foil form in room temperature. The foil-form soldering metal containing from 10% by weight to 90% by weight of Au and balance comprising Sn is subjected to heat treatment for five minutes to ten hours at 200° C. to 270° C., and subsequently the foil-form soldering metal is slit. Thus, the heat treatment of the Au—Sn soldering metal before slitting enables continuous slitting of the Au—Sn foil-form soldering metal in room temperature and facilitates the production of a ribbon-form soldering metal.

17 Claims, 2 Drawing Sheets

FOIL-FORM SOLDERING METAL AND METHOD FOR PROCESSING THE SAME

FIELD OF THE INVENTION

The present invention relates to a method for producing a foil-form soldering (filler) metal and, more particularly, to a method for processing a foil-form soldering metal for use in the process of producing a foil-form soldering metal having hard-to-work properties, for example, an Au—Sn foil-form soldering metal.

BACKGROUND ART

As a soldering metal for use in producing an optical device, such as a die bond for a Ga, As chip, there is an Au-20 wt % Sn soldering metal (referred to only as "An—Sn soldering metal" or only as "soldering metal" below) comprising 80% by weight of Au (gold) and 20% by weight of Sn (tin). The Au—Sn soldering metal is processed to a foil form, when using it for example for the above-described die bond for a Ga, As chip. Generally, the soldering is automatically performed with a soldering machine. A so-called ribbon-form Au—Sn soldering metal, which is a foil web or elongated foil form, is needed for the continuous soldering.

The ribbon-form Au—Sn soldering metal has conventionally been produced for example in a following manner. A metal ingot having 80% by weight of Au and 20% by weight of Sn is first cast through melt-casting, and the resultant ingot is rolled out. A foil-form soldering metal (a soldering metal having a thickness of for example 20 μm to 100 μm) obtained via the rolling is slit to a desired width to obtain a ribbon-form Au—Sn soldering metal.

However, the Au—Sn soldering metal as a workpiece, which is obtained through rolling an ingot, has properties of being brittle in room temperature and easily cracked. Therefore, if the slitting is applied to the soldering metal in room temperature, the soldering metal tends to be easily cracked at its edges during processing.

The crack occurs not only at the slitting but also at the rolling which is further performed when a thinner foil-form soldering metal is required, or at the blanking for producing a pattern-shape soldering metal for use, for example, in sealing the seal part of IC packages.

If the crack occurs, the ribbon-form soldering metal tends to be broken from the crack during or after processing. Therefore, it is difficult to work into a ribbon-form soldering metal or a foil-form soldering metal for sealing through the processing such as slitting, rolling or blanking in room temperature.

On the other hand, there is a processing method for hot working the foil-form soldering metal into a ribbon-form soldering metal or the like, and crack is relatively hard to occur according to this method. Slitting is described below as an example. For example, when the Au—Sn soldering metal as a workpiece obtained through rolling an ingot has a thickness of approximately 30 μm or more (generally 100 μm or less), a ribbon-form soldering metal can be produced through applying the slitting having a width of approximately 0.5 mm. However, for hot working such as hot slitting, a large scale apparatus is required, such that it is necessary to add facilities for heating an Au—Sn soldering metal and working tools such as a slitting blade, a reduction roll and a punch for blanking, or it is necessary to put working devices in an oil bath. Further, the processability for handling the soldering metal is very bad around the devices to which the heating facilities are added or which are in the oil bath. Therefore, the setting of the Au—Sn soldering metal as a workpiece to the device is difficult. In particular, when the thickness is approximately 20 μm or less, the setting of the soldering metal to the slitting device is difficult due to a low strength. Further, even if the setting is possible, the soldering metal tends to be cracked or broken during processing, so that it is hard to work it into a ribbon web or a pattern-shape soldering metal for sealing having a narrow part. In addition, there is a disadvantage that the processing operation becomes complicated such that regulation of the heating temperature is required for obtaining stable processing quality.

The present invention has been made in the above background, and it is an object of the present invention to provide a processing method capable of processing an Au—Sn soldering metal having a foil form in room temperature.

DISCLOSURE OF THE INVENTION

In order to achieve the above-described object, the inventors have studied the foil-form soldering metal as a workpiece obtained through rolling. The results have revealed that the soldering metal tends to be easily cracked during the working such as slitting, rolling or blanking, because a hard and brittle intermetallic compound is produced in the foil-form soldering metal containing 10% by weight to 90% by weight of Au and the rest comprising Sn. In addition, it has been found that the Au—Sn soldering metal as a workpiece has a section structure that looks elongated like a fiber (a white-looking ζ' phase and a black looking δ phase) (refer to FIG. 3), and that the presence of such a structure is considered to be one of the causes for producing cracks during processing.

As a result of a further study based on these results, the present invention has been created by discovering that, for a foil-form soldering metal as a workpiece obtained through hot working such as hot rolling, the foil-form soldering metal can continuously be processed in room temperature without producing cracks or breaks by further applying specific heat treatment before processing.

Applying heat treatment before processing such as slitting to an Au—Sn foil-form soldering metal as a workpiece has never been studied before, which is considered to be due to the following reasons. The first reason is that a foil-form soldering metal as a workpiece is the one that is generally obtained through hot working such as hot rolling. Because it is reasonable to judge that the obtained soldering metal as a workpiece is similar to the one which has already been subjected to heat treatment and there is no room for improving quality. The second reason is that an Au—Sn foil-form soldering metal as a workpiece can be handled as a flexible material as long as it is not subjected to any type of working. Because it is reasonable to judge that the properties of producing cracks during processing is inherent in the Au—Sn foil-form soldering metal, since an elongated foil-form soldering metal as a workpiece can be handled as a flexible material when for example winding it to a reel or unwinding it from the reel, for example.

The present invention comprises a method for processing a foil-form soldering metal containing from 10% by weight to 90% by weight of Au and the rest comprising Sn, comprising: subjecting the foil-form soldering metal to heat treatment for five minutes to ten hours at 200° C. to 270° C.; and then processing the foil-form soldering metal.

When the foil-form soldering metal as a workpiece is subjected to the heat treatment having these conditions, the hardness of the soldering metal is decreased (for example, Vickers hardness (Hv) is decreased from approximately 180 to approximately 150) as well as the fiber-form structure in the soldering metal is eliminated to form a so-called island structure (refer to FIG. 4), thereby eliminating internal defects or distortions of the soldering metal. Elimination of defects or distortions improves toughness of the soldering metal to improve processability (stabilize mechanical properties). It is in what is called an elastic state (having body).

If it is possible to improve processability of the foil-form soldering metal before processing in this manner, cracks during processing in room temperature can be prevented. Thus, handling properties are improved, for example, the foil-form soldering metal can easily be processed, as well as the yield of the processed product is improved, facilitating the working, in particular, continuous working of a soldering metal having a thickness of less than 30 μm which has been hard to work. In addition, the breaks starting from cracks are eliminated, so that the handling of the foil-form soldering metal after processing is improved. The processing method performed after the heat treatment includes, but not limited to, for example, slitting, rolling or blanking.

Various methods can be used for the heat treatment method of the foil-form soldering metal as a workpiece. For example, a batch process is preferred when a separate sheet of the foil-form soldering metal is used, and when a web is used, the batch process or a continuous heat treatment process, in which the web is continuously fed into a furnace, is used as appropriate.

Further studies have been made on the processing method by focusing attention on the fact that the processability of the foil-form soldering metal as a workpiece is improved by applying such a heat treatment. The results have revealed that a thinner ribbon-form soldering metal or a blanked soldering metal can be produced from a foil-form soldering metal after heat treatment, by further applying rolling followed by applying slitting or blanking in room temperature. A ribbon-form soldering metal having a thickness of 20 μm or less, which has been hard to produce in the prior art, is easily produced by this method. For example, in the case of slitting, a foil-form soldering metal as a workpiece having a thickness of 30 μm is subjected to heat treatment and then further rolled to form a thickness of 10 μm, which is then slit. It is considered that the foil-form soldering metal further subjected to rolling after heat treatment can be slit in room temperature because the island structure produced by the heat treatment remains.

Incidentally, when subjecting the foil-form soldering metal to heat treatment, the surface of the foil-form soldering metal may be oxidized (discolored). The oxidation of the surface of the foil-form soldering metal may produce an unmelted portion or a poorly brazed portion during soldering. The results of a study on the problem have revealed that it is preferred to perform the heat treatment of the foil-form soldering metal in vacuum, in a $H_2$ (hydrogen gas) atmosphere or in an inert gas atmosphere such as Ar (argon gas) or $N_2$ (nitrogen gas). Heat treatment in these atmospheres can securely prevent the oxidation of the surface of the foil-form soldering metal. The vacuum atmosphere is the lower the better, but conditions of $10^{-1}$ Pa to 10 Pa are actually used. The oxidation can be sufficiently prevented at 10 Pa or below, and a vacuum of $10^{-1}$ Pa has the same capability for preventing the oxidation compared with the vacuum below $10^{-1}$ Pa. On the other hand, the pressure is not limited in the case of a hydrogen gas atmosphere or an inert gas atmosphere, but the heat treatment of the foil-form soldering metal is preferably performed in a space where the gas is passed rather than in a space where the gas is in a stationary condition to obtain a good quality product.

Furthermore, the processing method according to the present invention is more preferably used for the foil-form soldering metal comprising from 29% by weight to 88% by weight of Au and the rest being Sn, because a higher effect of improvement can be obtained in the soldering metal having such a component. In addition, it has been found that the holding temperature and the time for holding during the heat treatment before processing is more preferably in the range from 230° C. to 250° C. and from 30 minutes to 180 minutes, respectively. Because the heat treatment in these conditions can better insure the processability required for the workpiece for slitting, rolling or blanking, particularly in a shorter length of time of the heat treatment.

BEST MODE FOR CARRYING OUT THE INVENTION

Preferred examples of the present invention will now be described with reference to the drawings.

Figure 1:
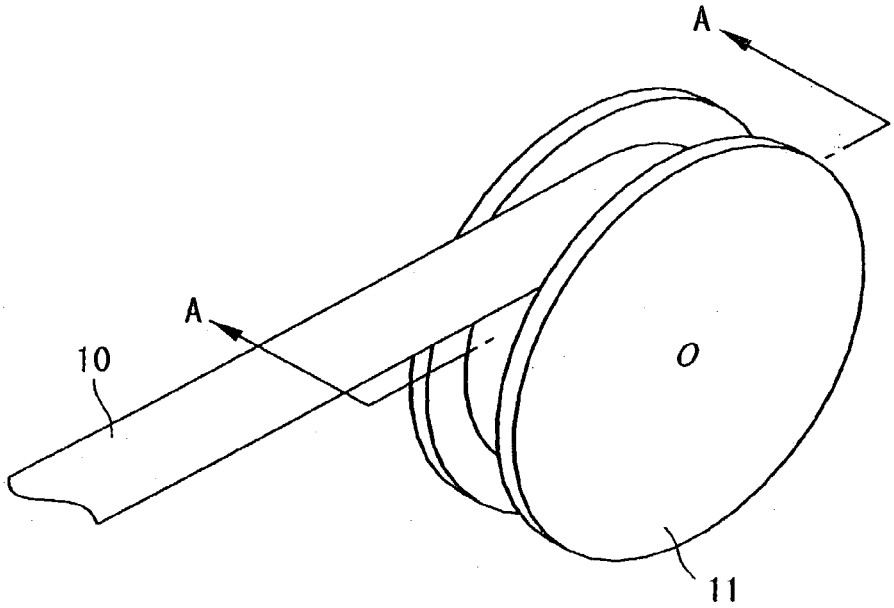
FIG. 1 is a perspective view illustrating a state in which a foil-form soldering metal is wound on a reel.
Figure 2:
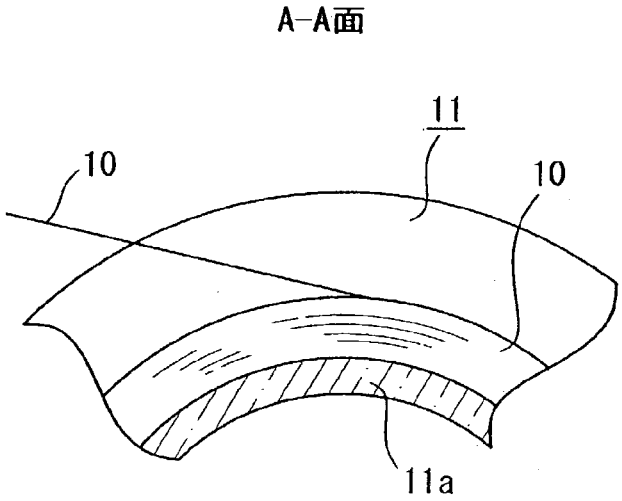
FIG. 2 is a partial sectional view taken along line A—A of FIG. 1 illustrating a state in which a foil-form soldering metal is being wound on a reel.
Figure 3:
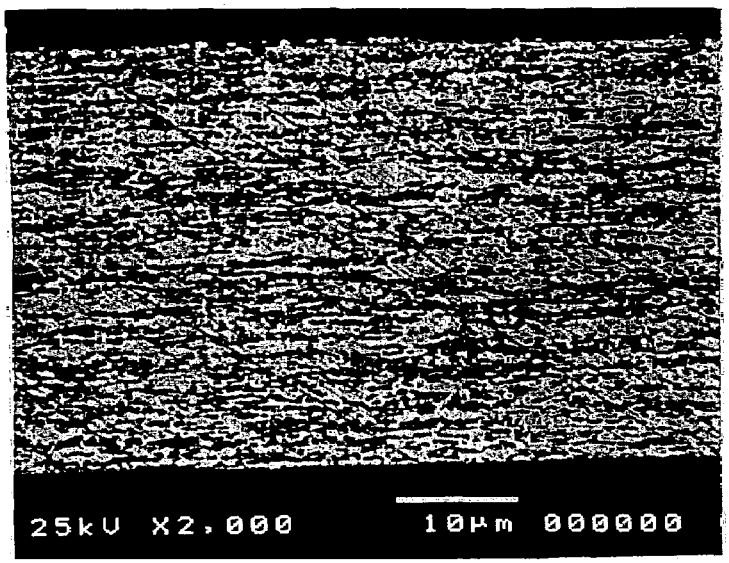
FIG. 3 is a photograph showing a cutting plane structure of a foil-form soldering metal before heat treatment.
Figure 4:
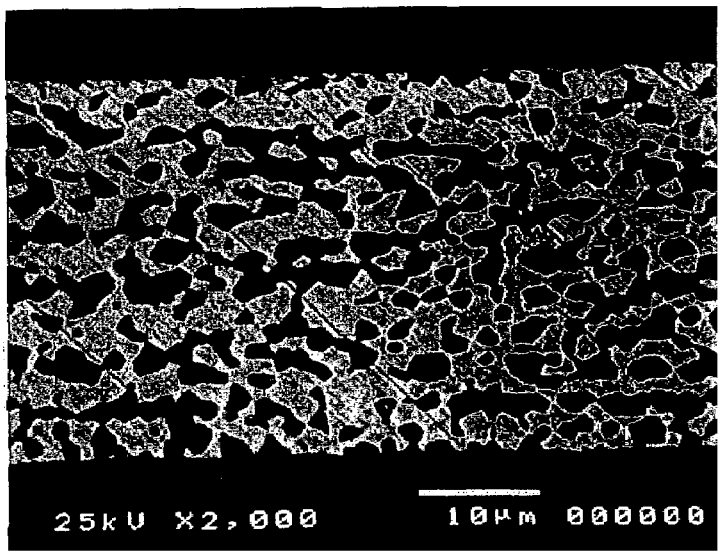
FIG. 4 is a photograph showing a cutting plane structure of a foil-form soldering metal after heat treatment.

An ingot of an Au-20 wt % Sn soldering metal was first produced via melt-casting, which was processed into an elongated foil-form soldering metal 10 by extrusion and rolling and was wound on a reel (made of SUS 304) 11 (refer to FIG. 1). The resultant elongated foil-form soldering metal 10 had a width of 20 mm, a thickness of 30 μm and a length of about 120 m. The outer diameter of a take-up spool 11*a* of the reel 11 was 100 mm (refer to FIG. 2).

EXAMPLE 1

An example of slitting is described. The obtained foil-form soldering metal web (a foil-form soldering metal as a workpiece) 10 was first subjected to heat treatment with a furnace. After completed the winding and before to be transferred into the furnace, a tape of stainless steel (not shown) was wound on the outermost perimeter of the foil-form soldering metal 10, and was fastened with a heat-resistant adhesive tape, thereby securing the foil-form soldering metal 10 so as not to come loose from the reel 11.

As for the conditions of the heat treatment, the foil-form soldering metal 10 was heated to 200° C. and then the temperature was held for 180 minutes. Subsequently, it was allowed to cool in the furnace. In addition, H2 gas (hydrogen gas) was passed around the reel 11 on which the elongated foil-form soldering metal 10 is wound during the heat treatment. Note that the obtained elongated foil-form soldering metal 10 may be rewound on another reel 11 for the purpose of for example adjusting the length of the foil-form soldering metal to be subjected to heat treatment.

After the heat treatment, the foil-form soldering metal 10 was unwound from the reel 11, and distortions such as waveform were corrected via an ironing step. After that, a plurality of ribbon-form foil-form soldering metal having a width of 0.3 mm were obtained through slitting with a multi-blade slitter. A hot plate heated to 240° C. was used in the ironing step.

EXAMPLES 2 TO 5 AND COMPARATIVE EXAMPLE 1

Ribbon-form foil-form soldering metals were obtained through performing heat treatment by use of the heat-treatment conditions different from Example 1. The conditions of the heat treatment for each of the examples are shown in Table 1. No heat treatment was performed in Comparative Example 1. All conditions other than the heat-treatment conditions were the same as those in Example 1, so that the description is omitted.

TABLE 1

| Examples/ Comparative Example | Heat treatment conditions: Temperature (° C.) | Heat treatment conditions: Time (min) | Evaluation of slitting: Break of ribbon during processing | Evaluation of slitting: Evaluation of cross-section (evaluation of crack) | Overall evaluation |
|---|---|---|---|---|---|
| Example 1 | 200 | 180 | No | Good | Good |
| Example 2 | 220 | 120 | No | Good | Good |
| Example 3 | 240 | 60 | No | Excellent | Excellent |
| Example 4 | 260 | 20 | No | Good | Good |
| Example 5 | 270 | 5 | No | Good | Good |
| Comparative Example 1 | — | — | Yes | — | Poor |

Common data: Width = 20 mm, Thickness = 30 μm and Length = 120 m for a foil-form soldering metal as a workpiece for slitting In Comparative Example 1 in which no heat treatment was performed, the ribbon was broken due to frequent occurrence of cracks during slitting, and it was impossible to obtain a ribbon having a length exceeding one meter. On the other hand, in the case of any of the examples, it was possible to perform good slitting with no break of the obtained ribbon, during slitting of the foil-form soldering metal having d length of 120 m. These results have revealed that good heat treatment can be performed when the temperature of the heat treatment is in the range of 200° C. and 270° C. A longer length of time of the heat treatment is more preferable for securing the heat treatment in this temperature range, but no difference was found in the resultant effect even if the heat treatment is performed longer than 10 hours. Specifically, it has been found that the heat treatment for 180 minutes is sufficient. It has also been found that the higher the heat-treatment temperature, the heat treatment can be performed in shorter time. Specifically, it was found that, in the case of 270° C., the heat treatment time of five minutes provides a necessary and sufficient effect for obtaining an elongated ribbon-form soldering metal. Furthermore, these results have revealed that also in the blanking for cutting the foil-form soldering metal into a specific shape, the heat treatment of the above-described conditions before processing improves processability to improve handling properties and the yield.

The cutting plane of the ribbon-form soldering metal obtained from each of the above-described examples was observed. The evaluation of the cross-section was good to excellent with almost no break being found in any of the foil-form soldering metals, among them the one obtained in Example 3 having extremely few cracks. These results have revealed that the conditions of the heat treatment before processing most preferably have a holding temperature of from 230° C. to 250° C. and a holding time of from 30 minutes to 90 minutes.

EXAMPLE 6

An example of rolling is described. Heat treatment conditions and an ironing step are the same as described for the slitting method in Example 1. In this example, the foil-form soldering metal after the ironing was fed into a rolling mill and hot rolled to obtain a foil-form soldering metal having a thickness of 10 μm, a width of 20 mm and a length of about 360 m. That is to say, the reduction ratio (=(thickness before rolling−thickness after rolling)/thickness before rolling× 100) was about 67%. The obtained elongated foil-form soldering metal was wound on another reel.

EXAMPLES 7 TO 10 AND COMPARATIVE EXAMPLE 2

Heat treatment was performed by use of the heat-treatment conditions different from Example 6, followed by rolling. The conditions of the heat treatment for each of the examples are shown in Table 2. No heat treatment was performed in Comparative Example 2. All conditions other than the heat-treatment conditions were the same as those in Example 6.

TABLE 2

| Examples/ Comparative Example | Heat treatment conditions: Temperature (° C.) | Heat treatment conditions: Time (min) | Evaluation of rolling: Rolling yield (%) | Evaluation of rolling: Evaluation of crack | Overall evaluation |
|---|---|---|---|---|---|
| Example 6 | 200 | 180 | 100 | Good | Good |
| Example 7 | 220 | 120 | 100 | Excellent | Excellent |
| Example 8 | 240 | 60 | 100 | Excellent | Excellent |
| Example 9 | 260 | 20 | 100 | Good | Good |
| Example 10 | 270 | 5 | 100 | Good | Good |
| Comparative Example 2 | — | — | 10 | Poor | Poor |

In the case of Comparative Example 2, a large number of fissures occurred in the foil-form soldering metal obtained through rolling, so that only about 40% (about 140 m) of them were usable for a foil-form soldering metal. On the other hand, in the case of the examples, good rolling was performed in any of the examples without large fissures on the surface of the foil-form soldering metal. The surface of the foil-form soldering metal obtained in each example was observed. The evaluation of the surface was good to excellent with almost no fissures (cracks) being found in any of the foil-form soldering metals, particularly those obtained in Example 7 and 8 (holding temperature of the heat treatment was from 210° C. to 250° C., and holding time was from 30 minutes to 150 minutes) being the best with extremely few fissures. These results have revealed that similar to the case of slitting, also in the case of rolling, the heat treatment of the above-described conditions before processing improves processability, provides a soldering metal having excellent quality without fissures (cracks) and improves the yield.

EXAMPLE 11

One example of slitting is described. Specifically, a method for slitting a foil-form soldering metal obtained through rolling after heat treatment is described. Rolling conditions, including heat-treatment conditions, were the same as Example 8, and slitting conditions were the same as Example 1. That is to say, according to the present example, the foil-form soldering metal obtained in Example 8 was slit with the multi-blade slitter used in Example 1.

TABLE 3

| Example | Rolling after heat treatment | Thickness of soldering metal (μm) | Evaluation of slitting: Slitting yield (%) | Evaluation of slitting: Evaluation of cross-section (evaluation of crack) | Overall evaluation |
|---|---|---|---|---|---|
| Example 11 | Yes | 10 | 100 | Good | Good |

In Example 11, no break of the obtained ribbon occurred during slitting of the foil-form soldering metal of 360 m, so that the slitting yield was 100%. This result has revealed that good slitting can be applied to the foil-form soldering metal having a reduction ratio of about 67%.

EXAMPLE 12

One example of blanking is described. Specifically, the foil-form soldering metal obtained through rolling after heat treatment was blanked. Conditions of the heat treatment before rolling, conditions of ironing step and conditions of the rolling were the same as Example 8. The foil-form soldering metal after the ironing step was fed to a blanking machine to obtain a ring-form soldering metal having an inner diameter of 0.3 mm, an outer diameter of 1 mm and a thickness of 10 μm.

COMPARATIVE EXAMPLE 3

Blanking without heat treatment is described. This example was different from Example 12 in having no heat treatment and no ironing step, but was the same as Example 12 in rolling conditions.

TABLE 4

| Examples/ Comparative Example | Heat treatment conditions: Temperature (° C.) | Heat treatment conditions: Time (min) | Evaluation of blanking: Rolling yield (%) | Evaluation of blanking: Blanking yield (%) | Evaluation of blanking: Evaluation of shear plane (evaluation of crack) | Overall evaluation |
|---|---|---|---|---|---|---|
| Example 12 | 240 | 60 | 100 | 100 | Good | Good |
| Comparative Example 3 | — | — | 10 | 10 | Poor | Poor |

In Comparative Example 3 which was not subjected to heat treatment, cracks frequently occurred on the shear plane of the soldering metal due to blanking, and the ring-form soldering metal was obtained only in about 10%. It has been found that the rolling yield before blanking is also low in the case of no heat treatment, resulting in extremely low productivity. Compared with this result, the yield for Example 12 was 100%, and it was able to apply good blanking. The shear planes of the soldering metals obtained in Example 12 and Comparative Example 3 were observed. The foil-form soldering metal of the example exhibited good results with almost no cracks, but the soldering filer metal foil obtained in Comparative Example 3 exhibited a large number of cracks. These results have revealed that also in the case of blanking, similar to slitting, the heat treatment of the above-described conditions before processing improves processability, provides a soldering metal having excellent quality without cracks and improves the yield.

ADVANTAGES OF THE INVENTION

As apparent from the above description, in accordance with the processing method according to the present invention, an Au—Sn foil-form soldering metal can be processed without producing defects such as cracks in room temperature.

What is claimed is:

1. A method for processing a foil-form soldering metal containing from 10% by weight to 90% by weight of Au and balance comprising Sn, comprising:

subjecting the foil-form soldering metal to heat treatment for five minutes to ten hours at 200° C. to 270° C.; and subsequently processing the foil-form soldering metal.

2. The method for processing a foil-form soldering metal according to claim 1, wherein the processing after heat treatment is slitting, rolling or blanking.

3. The method for processing a foil-form soldering metal according to claim 2, comprising the step of rolling after heat treatment before slitting or blanking.

4. The method for processing a foil-form soldering metal according to claim 1, wherein the heat treatment of the foil-form soldering metal is performed in a vacuum, in a hydrogen gas atmosphere or in an inert gas atmosphere.

5. The method for processing a foil-form soldering metal according to claim 2, wherein the heat treatment of the foil-form soldering metal is performed in vacuum, in a hydrogen gas atmosphere or in an inert gas atmosphere.

6. The method for processing a foil-form soldering metal according to claim 3, wherein the heat treatment of the foil-form soldering metal is performed in vacuum, in a hydrogen gas atmosphere or in an inert gas atmosphere.

7. A foil-form soldering metal containing from 10% by weight to 90% by weight of Au and balance comprising Sn, which is manufactured by a method comprising subjecting the foil-form soldering metal to heat treatment for five minutes to ten hours at 200° C. to 270° C.; and subsequently processing the foil-form soldering metal.

8. A foil-form soldering metal according to claim 7, wherein said foil-form soldering metal has an internal structure including a ζ' phase and a δ phase, and said internal structure further has a cross-sectional structure in which said ζ' phase assumes a substrate and said δ phase is distributed in the form of islands in the substrate.

9. A foil-form soldering metal, according to claim 7, wherein said foil-form soldering metal has an internal structure including a δ phase and a ζ' phase, and said internal structure further has a cross-sectional structure in which said δ phase assumes a substrate and said ζ' phase is distributed in the form of islands in the substrate.

10. A foil-form soldering metal containing 10 wt. % to 90 wt. % of Au and balance of Sn, and having an internal structure including a ζ' phase and a δ phase, wherein said internal structure has a cross-sectional structure in which said ζ' phase assumes a substrate and said δ phase is distributed in the form ofislands in the substrate.

11. A foil-form soldering metal containing 10 wt % to 90 wt % of Au and balance of Sn, and having an internal structure including a ζ' phase and a δ phase, wherein said internal structure has a cross-sectional structure in which said δ phase assumes a substrate and said ζ' phase is distributed in the form of islands in the substrate.

12. A foil-form soldering metal according to claim 7, wherein said metal contains 29 wt % to 8 wt % of Au and balance of Sn.

13. A foil-form soldering metal according to claim 7, wherein said metal contains about 80 wt % of Au and balance of Sn.

14. A foil-form soldering metal according to claim 10, wherein said metal contains 29 wt % to 88 wt % of Au and balance of Sn.

15. A foil-form soldering metal according to claim 10, wherein said metal contains about 80 wt % of Au and balance of Sn.

16. A foil-form soldering metal according to claim 11, wherein said metal contains 29 wt % to 88 wt % of Au and balance of Sn.

17. A foil-form soldering metal according to claim 11, wherein said metal contains about 80 wt % of Au and balance of Sn.

* * * * *